US010581194B2

(12) United States Patent
Baba et al.

(10) Patent No.: US 10,581,194 B2
(45) Date of Patent: Mar. 3, 2020

(54) CONNECTOR WITH TUBULAR BODIES

(71) Applicant: Yazaki Corporation, Tokyo (JP)

(72) Inventors: Ayako Baba, Utsunomiya (JP); Kozo Oishi, Utsunomiya (JP); Tomoyuki Miyakawa, Utsunomiya (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/416,746

(22) Filed: May 20, 2019

(65) Prior Publication Data

US 2019/0280425 A1 Sep. 12, 2019

Related U.S. Application Data

(63) Continuation of application No. PCT/JP2017/035615, filed on Sep. 29, 2017.

(30) Foreign Application Priority Data

Dec. 22, 2016 (JP) ..... 2016-250019

(51) Int. Cl.
*H01R 13/52* (2006.01)
*H01R 13/627* (2006.01)
*H01R 13/639* (2006.01)

(52) U.S. Cl.
CPC ..... *H01R 13/5219* (2013.01); *H01R 13/52* (2013.01); *H01R 13/6272* (2013.01); *H01R 13/639* (2013.01)

(58) Field of Classification Search
CPC ..... H01R 13/5219; H01R 13/6272; H01R 13/639
USPC ..... 439/271
See application file for complete search history.

(56) References Cited

U.S. PATENT DOCUMENTS

| | | | | |
|---|---|---|---|---|
| 5,248,263 | A | 9/1993 | Sakurai et al. | |
| 2001/0035652 | A1 | 11/2001 | Wada et al. | |
| 2007/0072471 | A1* | 3/2007 | Miyakawa | H01R 43/005 439/274 |
| 2007/0275589 | A1* | 11/2007 | Ohtaka | H01R 13/518 439/354 |

(Continued)

FOREIGN PATENT DOCUMENTS

| | | | |
|---|---|---|---|
| JP | 4-78772 | U | 7/1992 |
| JP | 2001-250636 | A | 9/2001 |

(Continued)

OTHER PUBLICATIONS

International Search Report (PCT/ISA/210) dated Dec. 5, 2017 issued by the International Searching Authority in International Application No. PCT/JP2017/0035615.

(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A connector has one housing having a tubular body which surrounds terminals; the other housing having a tubular body to be connected to the tubular body of the one housing; and a lock mechanism which allows tip surfaces of the tubular bodies that define external shapes of the pair of housings, respectively, to come into contact with each other and maintains a connected state of the one housing and the other housing.

8 Claims, 14 Drawing Sheets

(56) References Cited

U.S. PATENT DOCUMENTS

2010/0267264 A1* 10/2010 Sawairi ..... H01R 13/5219
439/271

FOREIGN PATENT DOCUMENTS

| | | | |
|---|---|---|---|
| JP | 2008-186646 | A | 8/2008 |
| JP | 2015-103372 | A | 6/2015 |

OTHER PUBLICATIONS

Written Opinion (PCT/ISA/237) dated Dec. 5, 2017 issued by the International Searching Authority in International Application No. PCT/JP2017/0035615.
Communication dated Mar. 5, 2019, issued by the Japanese Patent Office in counterpart Japanese Application No. 2016-250019.

* cited by examiner

CONNECTOR WITH TUBULAR BODIES

CROSS REFERENCE TO RELATED APPLICATIONS

This application is a continuation of PCT application No. PCT/JP2017/035615, which was filed on Sep. 29, 2017 based on Japanese Patent Application (No. 2016-250019) filed on Dec. 22, 2016, the contents of which are incorporated herein by reference.

BACKGROUND OF THE INVENTION

1. Field of the Invention

The present invention relates to a connector.

2. Description of the Related Art

Conventional connectors are known which are configured so as to be equipped with a female housing having an inside tubular body that houses female terminals and an outside tubular body that covers the inside tubular body, and a male housing which is inserted in a space between the inside tubular body and the outside tubular body and has a tubular body that houses male terminals (refer to JP-A-2015-103372). In connectors of this kind, connection portions between the male terminals and the female terminals are made waterproof by attaching a ring-shaped packing to the outer circumferential surface of the inside tubular body of the female housing and bringing the packing into close contact with the inner circumferential surface of the tubular body of the male housing that is inserted in a space between the outer circumferential surface of the packing and the inner circumferential surface of the outside tubular body of the female housing.

However, in the connector of JP-A-2015-103372, it is necessary to form, between the inside tubular body and the outside tubular body of the female housing, a space in which to provide the packing and a space in which to insert the tubular body of the male housing. Thus, the external dimensions of the female housing are increased and, as a result, the external dimensions of the connector are made large.

SUMMARY OF THE INVENTION

A first object of the invention is to miniaturize a connector, and a second object of the invention is to secure necessary waterproofness of the connector.

To solve the above problem, the invention has the following configurations.

(1) A connector including one housing having a tubular body which surrounds terminals; the other housing having a tubular body to be connected to the tubular body of the one housing; and a lock mechanism which allows tip surfaces of the tubular bodies that define external shapes of the pair of housings, respectively, to come into contact with each other and maintains a connected state of the one housing and the other housing.

In the connector having the configuration of item (1), the tip surface of the tubular body that defines an external shape of the one housing and the tip surface of the tubular body that defines an external shape of the other housing come into contact with each other, it is not necessary to form, inside the one housing, a space in which to insert the tubular body of the other housing. As a result, the external dimensions of the tubular body of the one housing can be made smaller and hence the connector can also be made smaller.

(2) The connector according to item (1), wherein the tubular body of the one housing has an inside tubular body which houses the terminals and an outside tubular body which is disposed so as to be concentric with and to surround the inside tubular body; the outside tubular body is attached, from outside, to the inside tubular body so as to be slidable in an axial direction of the inside tubular body, and has a rib which projects from an inner circumferential surface of the outside tubular body at its front end and prevents the outside tubular body from coming off the inside tubular body by coming into contact with a brim that projects from an outer circumferential surface of the inside tubular body; a ring-shaped packing which is formed so as to be able to be inserted into the tubular body of the other housing and is configured to seal a gap between an inner circumferential surface of the tubular body of the other housing and a portion of an outer circumferential surface of the inside tubular body which is located closer to a tip side of the inside tubular body than the brim; and the lock mechanism is formed so as to establish the connected state at a position where the tip surface of the tubular body of the other housing comes into contact with a tip surface of the outside tubular body and the rib of the outside tubular body comes into contact with the brim of the inside tubular body.

In the connector having the configuration of item (2), since the tip surface of the outside tubular body that defines an external shape of the one housing and the tip surface of the tubular body that defines an external shape of the other housing come into contact with each other, it is not necessary to form, between the inside tubular body and the outside tubular body, a space in which to insert the tubular body of the other housing. As a result, the external dimensions of the outside tubular body of the one housing can be made smaller and hence the connector can also be made smaller. Furthermore, the outside tubular body of the one housing is attached to its inside tubular body from outside so as to be slidable in the axial direction of the inside tubular body. Thus, after the tip surface of the outside tubular body is pressed against the tubular body of the other housing, the outside tubular body of the one housing slides in a state that its tip surface and the tip surface of the tubular body of the other housing are kept in contact with each other. As a result, at a position where the rib of the outside tubular body comes into contact with the brim of the inside tubular body as a result of sliding of the outside tubular body, a state is established that the inside tubular body is inserted in the tubular body of the other housing and the packing which is attached to the inside tubular body comes into close contact with the inner circumferential surface of the tubular body of the other housing, whereby necessary waterproofness of the connector can be secured.

(3) The connector according to item (2), wherein the outside tubular body of the one housing covers, to its tip, the packing attached to the outer circumferential surface of the inside tubular body in a prescribed state before the tubular body of the other housing comes into contact with the outside tubular body.

In the connector having the configuration of item (3), covered with the outside tubular body in advance, the packing is covered with the tubular body of the other housing and hence can be prevented from being exposed even when the tubular body of the other housing comes into contact with the outside tubular body and causes it to slide. As a result, degradation of the packing due to exposure to an external environment can be suppressed, whereby the connector can be kept waterproof for a long time.

(4) The connector according to item (2), wherein a tip of the inside tubular body projects beyond the tip of the outside tubular body; the inside tubular body has plural projections which project beyond the tip of the inside tubular body; and the projections are arranged around the axis of the inside tubular body so as to be spaced from each other.

In the connector having the configuration of item (4), when, for example, a certain object comes into contact with the connector, the object comes into contact with a projection, whereby an event that the object touches the tip of the inside tubular body can be prevented. As a result, although the tip of the inside tubular body projects beyond the tip of the outside tubular body, the tip of the inside tubular body can be prevented from being damaged.

(5) The connector according to item (1), wherein the lock mechanism has a lock arm which is supported by an elastic support member provided on an outer surface of the one housing so as to be swingable in a plane perpendicular to the outer surface of the one housing, and extends toward a front end side and a rear end side of the one housing; an engagement portion to engage with an engagement target portion formed on an outer surface of the other housing is formed at a tip of the lock arm, and a manipulation portion for disengaging the engagement portion from the engagement target portion is provided at a rear end of the lock arm; and respective stoppers for restricting an upper limit of a swing range of the lock arm are provided on parts of walls of the one housing, and the parts of the walls are located on two respective sides of the lock arm and are located closer to the engagement portion than the support member.

In the connector having the configuration of item (5), to disengage the engagement portion of the lock arm from the engagement target portion of the other housing, manipulations are performed that the manipulation portion which is provided at the rear end of the lock arm is pushed toward the outer surface of the one housing, the supporting point member located between the tip of the lock arm and the manipulation portion is brought into contact with the outer surface of the one housing, and the engagement portion provided at the tip of the lock arm is lifted up with the contact portion serving as a supporting point. At this time, if the manipulation portion is pushed too much toward the outer surface of the one housing, an excessive stress might act on the support member for the lock arm to deform the support member permanently. To solve this problem, in this configuration, the stopper is provided which restricts the upper limit of the swing range of the lock arm. Thus, even if the manipulation portion is pushed too much during a manipulation for disengaging the engagement portion of the lock arm from the engagement target portion, the lock arm is not swung beyond the upper limit. As a result, an event that an excessive stress acts on the support member can be prevented and hence permanent deformation of the support member can be prevented.

(6) The connector according to item (1), wherein the lock mechanism has a lock arm which is supported by an elastic support member provided on an outer surface of the one housing so as to be swingable in a plane perpendicular to the outer surface of the one housing, and extends toward a front end side and a rear end side of the one housing; an engagement portion to engage with an engagement target portion formed on an outer surface of the other housing is formed at a tip of the lock arm, and a manipulation portion for disengaging the engagement portion from the engagement target portion is provided at a rear end of the lock arm; the lock arm is provided with, between its tip and the manipulation portion, a supporting point member whose tip is spaced from the outer surface of the one housing by a set interval; and the supporting point member is tapered so that the interval between the supporting point member and the support member as viewed from the side of the manipulation portion of the lock arm increases as the position goes toward the outer surface of the one housing.

In the connector having the configuration of item (6), when viewed from the side of the manipulation portion of the lock arm, a space is formed between the supporting point member and the support member. The space is formed using a component of a die for resin molding. Thus, if, for example, the lock arm is miniaturized and the space is narrowed, the die component is made thinner, which may lower the durability of the die due to insufficiency in strength. To solve this problem, in this configuration, the supporting point member is tapered so that the interval between the supporting point member and the support member increases as the position goes toward the outside surface of the one housing. With this measure, the component of the die for forming the space between the supporting point member and the support member can be made thicker. As a result, the die can be increased in strength and hence in durability.

The invention can miniaturize a connector. In addition to being capable of miniaturizing the connector, the invention can secure necessary waterproofness of the connector.

DETAILED DESCRIPTION OF THE EXEMPLARY EMBODIMENTS

Embodiment 1

A connector according to a first embodiment of the present invention will be hereinafter described with reference to the drawings.

Figure 1:
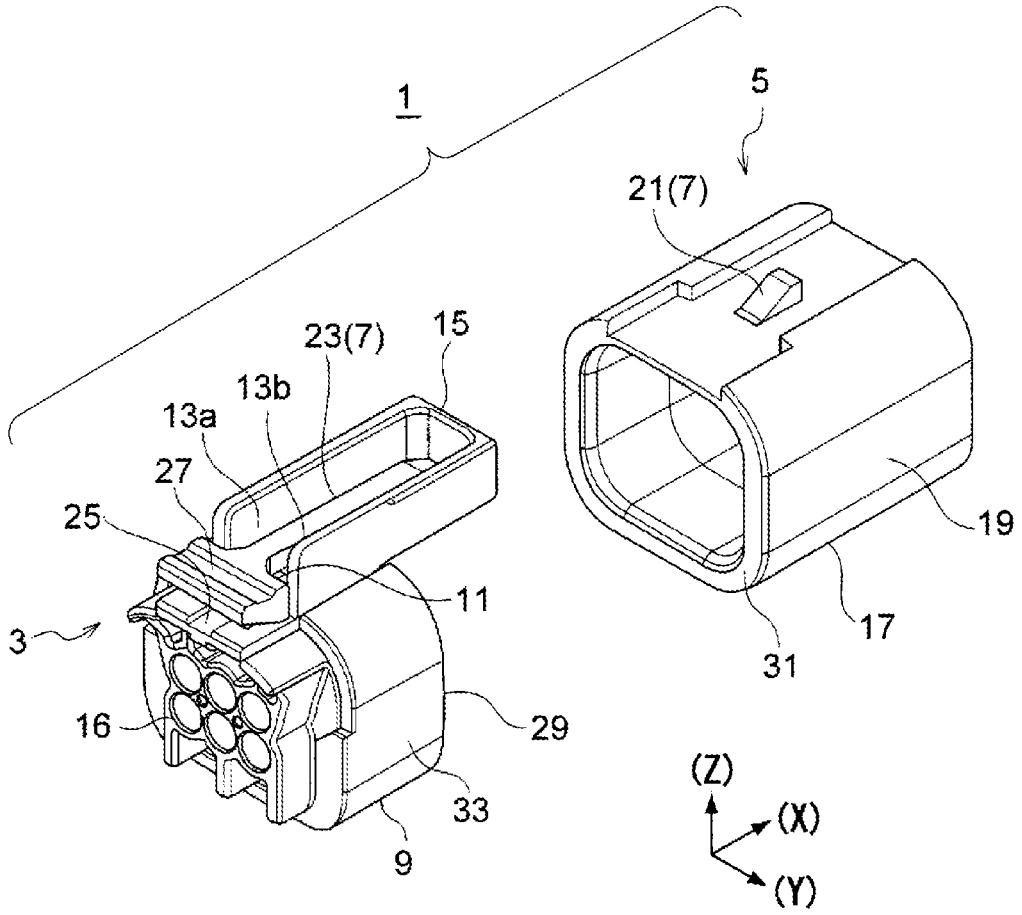
FIG. 1 is a perspective view of a female housing and a male housing which constitute a connector according to a first embodiment of the present invention.

FIG. 1 is a perspective view of a female housing 3 and a male housing 5 which constitute the connector 1 according to the first embodiment. The connector 1 according to the first embodiment is configured so as to be equipped with the female housing 3 (one housing) and the male housing 5 (the other housing), and a lock mechanism 7 for maintaining a connected state of the female housing 3 and the male housing 5. The following description will be made with definitions that the (X) direction, the (Y) direction, and the (Z) direction shown in FIG. 1 correspond to the front-rear direction, the width direction, and the height direction, respectively, the fitting direction of the housings corresponds to the forward direction, and the top side of FIG. 1 corresponds to the upward direction.

The female housing 3 is made of a synthetic resin and has a rectangular-pipe-shaped hood 9 which houses plural female terminals (not shown). The hood 9 defines an external shape of the female housing 3 and houses, inside, a terminal holding portion (not shown) which holds the female terminals. The hood 9 has an opening 11 that is formed cutting away its top portion extending in the axial direction (front-rear direction) and has such a setting width as to allow access to the inside of the hood 9, and a protection wall 15 which is erected from the outer circumferential surface of the hood 9 so as to have a pair of side walls 13*a* and 13*b* opposed to each other in the width direction of the opening 11 and projects forward from the hood 9 like a gate. The hood 9 is formed with, at the rear end, wire outlets 16 through which electric wires connected to the respective female terminals are led out.

The male housing 5 is made of a synthetic resin and has a rectangular-pipe-shaped tubular body 17 to be connected to the hood 9 of the female housing 3. While the tubular body 17 defines an external shape of the male housing 5, it has a hollow cap structure that it is closed at the rear end by a bottom plate (not shown). The tubular body 17 may house male terminals to be connected to the respective female terminals housed in the female housing 3.

The lock mechanism 7 has an engagement target portion 21 which projects from a top portion of an outer circumferential surface 1 of the tubular body 17 and a lock arm 23 which is supported swingably by the outer surface of the female housing 3 and engages with the engagement target portion 21 and maintains a connected state when the female housing 3 and the male housing 5 are connected to each other. The lock arm 23 is supported by a support member (not shown) that projects from a top portion, located closer to the rear end than the opening 11 is, of an outer surface 25 of the female housing 3. The lock arm 23 extends in the direction connecting the front end side and the rear end side of the female housing 3, and a portion located on the front end side is disposed inside the protection wall 15. An engagement portion (not shown) to be locked on the engagement target portion 21 of the male housing 5 projects from the bottom surface of a front end portion of the lock arm 23, and the rear end of the lock arm 23 is provided with a manipulation portion 27 for disengaging the engagement portion from the engagement target portion 21. The manipulation portion 27 is spaced from the outer surface 25 of the female housing 3.

The female housing 3 and the male housing 5 are configured so that a tip surface 29 of the hood 9 of the female housing 3 and a tip surface 31 of the tubular body 17 of the male housing 5 come into contact with each other when the housings 3 and 5 are connected to each other. An outer circumferential surface 19 of the tubular body 17 of the male housing 5 is formed so as to correspond to an outer circumferential surface 33 of the hood 9 of the female housing 3. That is, the external dimensions of the female housing 3 and the male housing 5 are set so that their outer circumferential surfaces 33 and 19 are approximately flush with each other along the circumferential direction when the tip surface 29 of the hood 9 and the tip surface 31 of the tubular body 17 are in contact with each other.

In a state that the tip surface 29 of the hood 9 and the tip surface 31 of the tubular body 17 are in contact with each other, the lock mechanism 7 functions and the engagement portion of the lock arm 23 engages with the engagement target portion 21, whereby a connected state of the hood 9 and the tubular body 17, that is, a connected state of the female housing 3 and the male housing 5, is maintained.

As described above, in the connector 1 according to the first embodiment, the tip surface 29 of the hood 9 which defines the external shape of the female housing 3 and the tip surface 31 of the tubular body 17 which defines the external shape of the male housing 5 are in contact with each other in a state that the female housing 3 and the male housing 5 are connected to each other. It is therefore not necessary to form, inside the hood 9 of the female housing 3, a space in which to insert the tubular body 17 of the male housing 5. As a result, the external dimensions of the hood 9 of the female housing 3 can be made equal to or smaller than those of the tubular body 17. The connector 1 can thus be made smaller.

In the connector 1 according to the first embodiment, the lock mechanism 7 is provided at one position, that is, in the top portion of the connector 1. Alternatively, lock mechanisms 7 may be provided at two respective positions that are symmetrical with each other with respect to the axis of the connector 1, that is, top and bottom positions or left and right positions. This measure makes it possible, reliably, to prevent deviation between the axes of the hood 9 and the tubular body 17.

Furthermore, in the connector 1 according to the first embodiment, the tip surface 29 of the hood 9 and the tip surface 31 of the tubular body 17 are both a flat surface. However, the shapes of the tip surfaces 29 and 31 are not limited to a flat surface; it suffices that the tip surfaces 29 and 31 be shaped so as to be able to engage with each other. For example, the close contactness between the tip surfaces 29 and 31 can be increased by forming one of them with a ring-shaped projection and the other with a ring-shaped recess to engage with projection.

Although in the connector 1 according to the first embodiment the hood 9 and the tubular body 17 are each shaped like a rectangular pipe, their shapes are not limited to a rectangular pipe and may be a circular pipe, for example.

Connectors according to other embodiments of the invention will be described below. However, all of these embodiments are basically similar to the above-described first embodiment and can provide the same advantages as the first embodiment. Thus, in the following, only a structure that is characteristic of each of those embodiments will be described and descriptions of structures common to the first embodiment will be omitted.

Embodiment 2

Next, a connector according to a second embodiment of the invention will be described.

Figure 2:
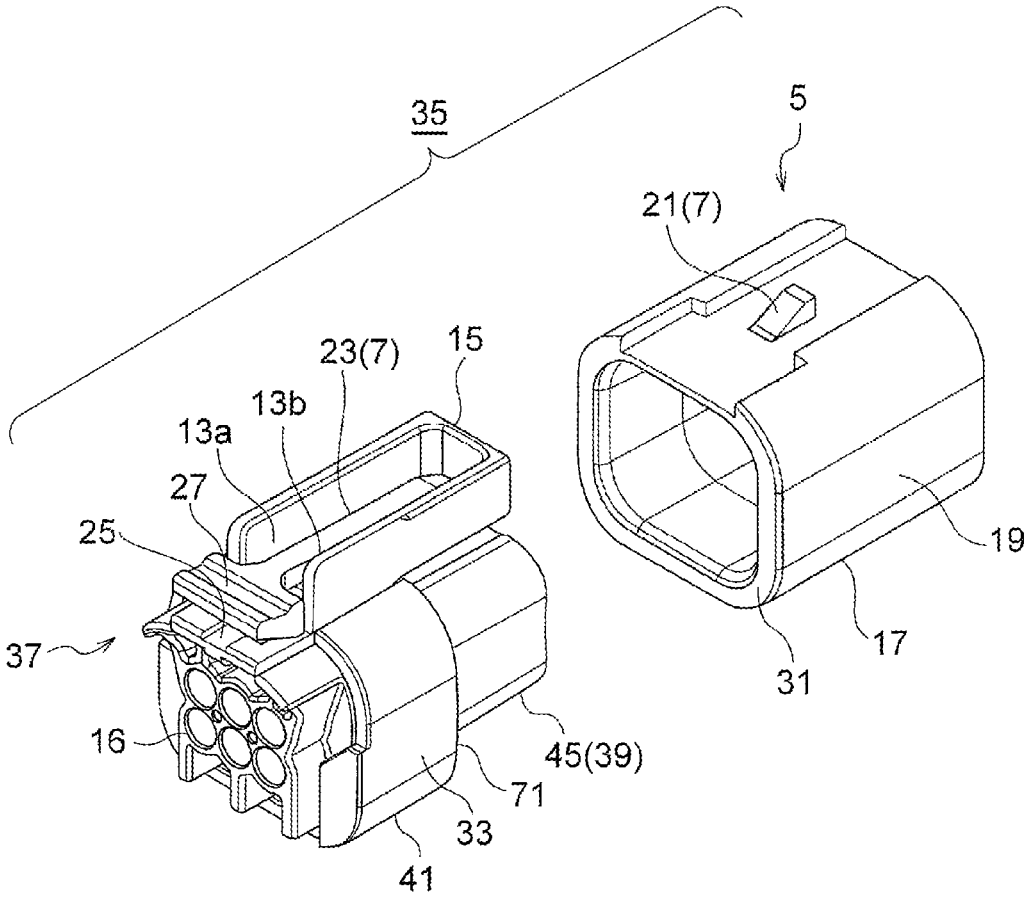
FIG. 2 is a perspective view of a female housing and a male housing which constitute a connector according to a second embodiment of the invention.
Figure 3:
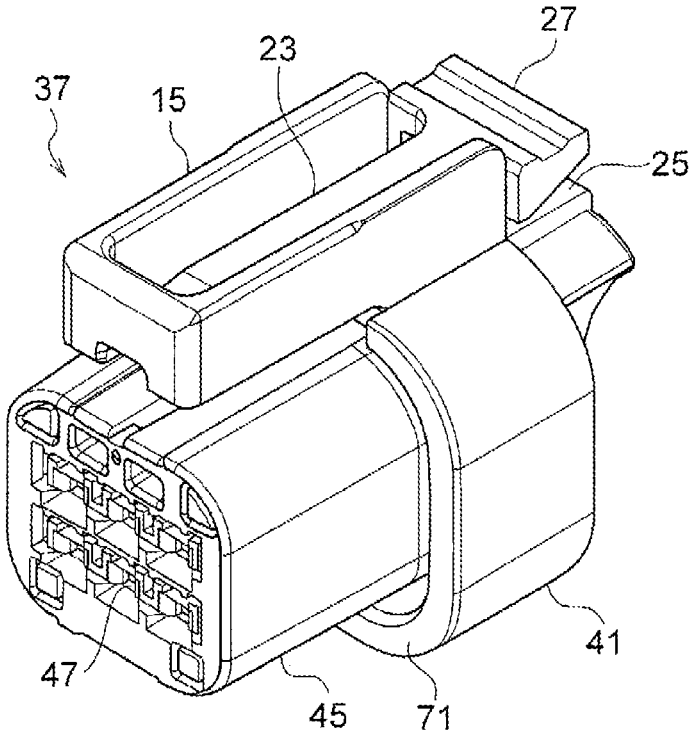
FIG. 3 is a perspective view showing an appearance, before fitting, of the female housing shown in FIG. 2.
Figure 4:
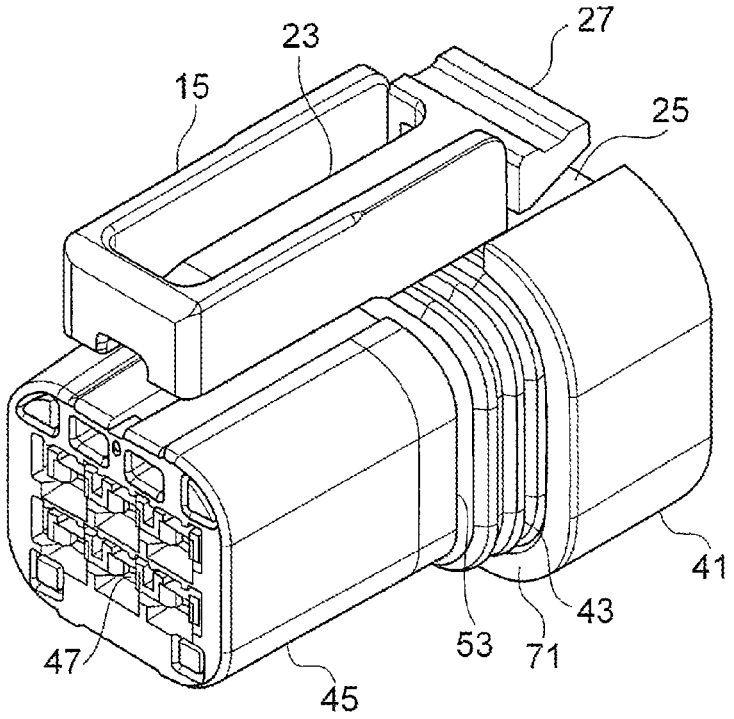
FIG. 4 is a perspective view showing an appearance, in a fitted state, of the female housing shown in FIG. 3.

FIG. 2 is a perspective view of a female housing 37 and a male housing 5 which constitute a connector 35 according to the second embodiment of the invention. FIG. 3 is a perspective view of the female housing 37 before fitting. FIG. 4 is a perspective view of the female housing 37 in a fitted state. The connector 35 according to the second embodiment is different from the connector 1 according to the first embodiment in the structure of the female housing 37, and hence the female housing 37 will be described mainly.

The female housing 37 is made of a synthetic resin, and has an inside tubular body 39 (see FIG. 5) and an outside tubular body 41 which surrounds the inside tubular body 39 so as to be concentric with it and defines an external shape of the female housing 37. The outside tubular body 41 is shaped like a rectangular pipe as a whole and is attached, from outside, to the inside tubular body 39 so as to be slidable in the axial direction of the inside tubular body 39. The outside tubular body 41 has a tip surface 71 to come into contact with the tip surface 31 of the tubular body 17 and, as described later, is to be connected to the tubular body 17 in a state that the tubular body 17 is in contact with the tip surface 71. As such, the outside tubular body 41 employed in the second embodiment corresponds to the hood 9 employed in the first embodiment.

Figure 5:
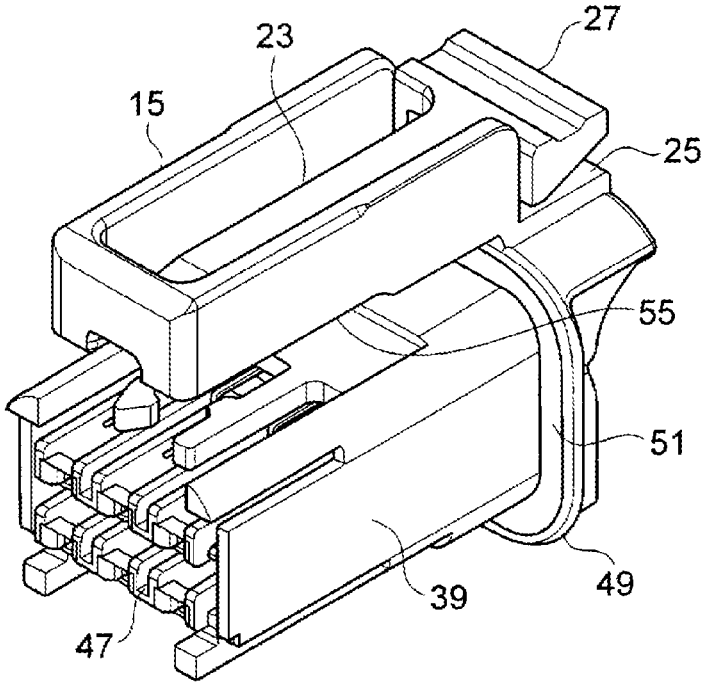
FIG. 5 is a perspective view of an inside tubular body which is part of the female housing.

FIG. 5 is a perspective view showing an appearance of the inside tubular body 39. The inside tubular body 39 will be described below with reference to FIGS. 4 and 5.

The inside tubular body 39 is shaped like a rectangular pipe as a whole though its tip portion is formed with plural cuts. A ring-shaped packing 43 made of rubber is attached to the outer circumferential surface of the inside tubular body 39, and a rectangular-pipe-shaped front holder 45 is attached to the inside tubular body 39 from the front side. The front holder 45 is a member for positioning tip portions of female terminals housed in the inside tubular body 39 and preventing the packing 43 from coming off forward. A tip portion of the inside tubular body 39, which is not to be connected to the tubular body 17 of the male housing 5, projects forward beyond the tip of the outside tubular body 41 and is exposed there and is formed so as to be able to be inserted into the tubular body 17 of the male housing 5 in a state that the front holder 45 is attached to the inside tubular body 39. Plural terminal housing rooms 47 for housing the respective female terminals are formed inside the inside tubular body 39 so as to be open to the front side. The terminal housing rooms 47 are formed so as to engage with and hold at set positions the female terminals inserted into them through rear wire outlets 16 of the inside tubular body 39, respectively.

The inside tubular body 39 has a brim 49 which projects from an entire circumference of its outer circumferential surface at its rear end. The packing 43 which is attached to the outer circumferential surface of the inside tubular body 39 is held between a front, side surface 51 of the brim 49 and a rear end surface 53 of the front holder 45. A protection wall 15 and a lock arm 23 are supported by a top portion, located in the rear of the brim 49, of an outer surface 25 of the inside tubular body 39 of the female housing 37. The protection wall 15 and the lock arm 23 extend forward and a space 55 into which the tubular body 17 of the male housing 5 is to be inserted is formed between them and the inside tubular body 39. The lock arm 23 has the same structure as in the first embodiment.

Figure 6:
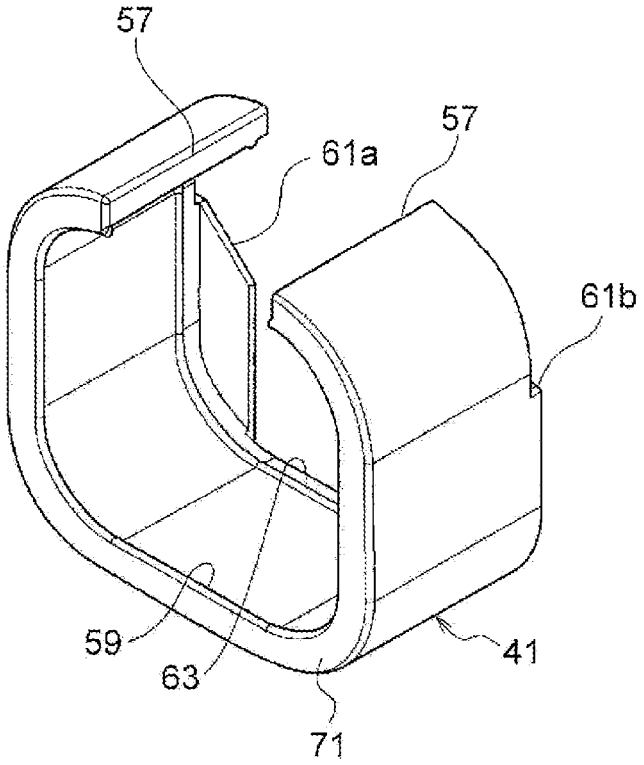
FIG. 6 is a perspective view of an outside tubular body which is part of the female housing.

FIG. 6 is a perspective view showing an appearance of the outside tubular body 41.

As shown in the figure, the outside tubular body 41 has a cut 57 extending in the axial direction (front-rear direction) and is shaped like a rectangular pipe as a whole. The cut 57 serves to prevent the outside tubular body 41 from interfering with the lock arm 23 and the protection wall 15 of the inside tubular body 39 when the outside tubular body 41 is slid in the axial direction of the inside tubular body 39. To this end, when the outside tubular body 41 that is attached to the inside tubular body 39 from outside is viewed from above, as shown in FIGS. 3 and 4 the manipulation portion 27 of the lock arm 23 and the protection wall 15 are located inside the cut 57. The outside tubular body 41 need not be formed with the cut 57 in the case where the manipulation portion 27 of the lock arm 23 and the protection wall 15 are provided at such positions as not to interfere with the outside tubular body 41.

The outside tubular body 41 has a rib 59 which projects from the front end (left end in FIG. 6) of its inner circumferential surface, a pair of lock pieces 61*a* and 61*b* which project from the rear end of its inner circumferential surface, and a lock portion 63 which projects from a portion, closer to the rear end than the front end between them, of its inner circumferential surface. The rib 59 extends in the circumferential direction parallel with the inner circumferential surface and projects toward the inside of the outside tubular body 41 perpendicularly to the axial direction of the outside tubular body 41. As described later, the rib 59 has a function of preventing the outside tubular body 41 from coming off the inside tubular body 39. The pair of lock pieces 61*a* and 61*b* are provided on the two respective sides in the width direction at the rear end of the outside tubular body 41 and extend inward perpendicularly to the axial direction of the outside tubular body 41. The lock portion 63 extends in the circumferential direction parallel with the inner circumferential surface at the position close to the rear end of the outside tubular body 41, has a lower projection height than the rib 59, and is semicircular in cross section.

Next, the configuration of an assembly that the outside tubular body 41 is attached to the inside tubular body 39 so as to be located outside it.

Figure 7:
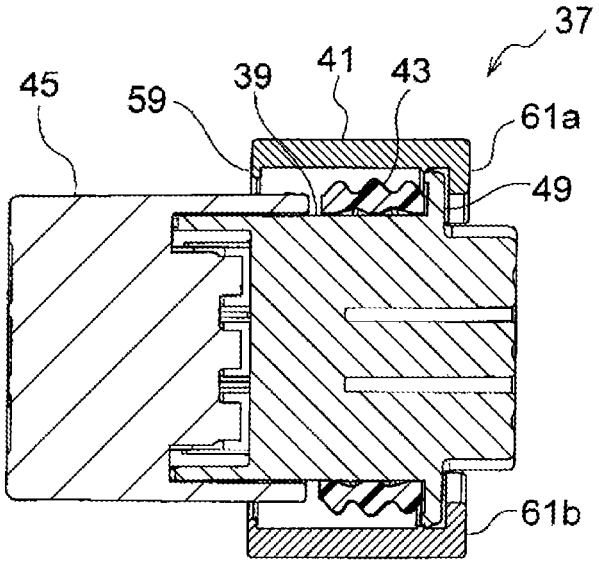
FIG. 7 is a sectional view of the female housing in a prescribed state before fitting.
Figure 8:
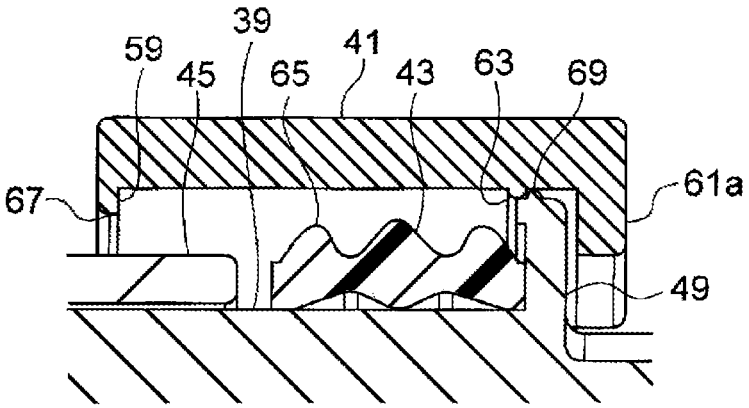
FIG. 8 is an enlarged view of part of FIG. 7.
Figure 9:
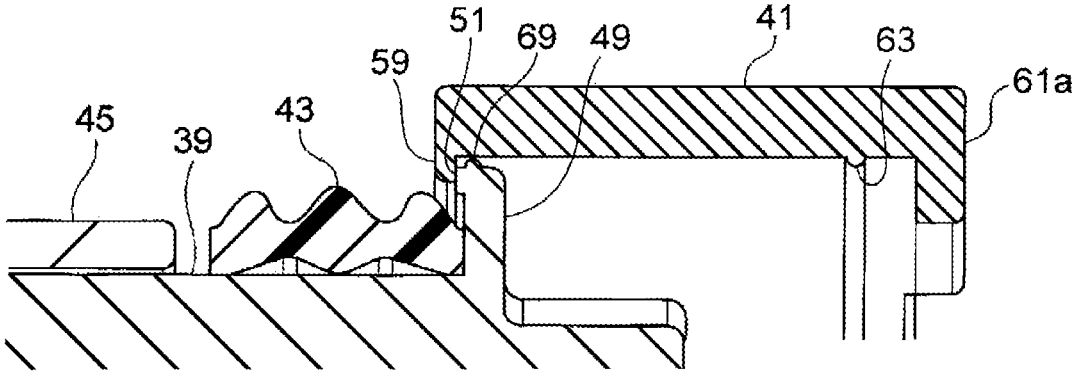
FIG. 9 is an enlarged sectional view of part of the female housing when it is fitted with the male housing.

FIG. 7 is a sectional view of the female housing 37 in a prescribed state before fitting. FIG. 8 is an enlarged view of part of FIG. 7. FIG. 9 is an enlarged sectional view of part of the female housing 37 when it is fitted with the male housing 5. The male housing 5 is omitted in FIG. 9.

As shown in FIG. 7, in an initial state before fitting of the female housing 37 (i.e., in the prescribed state before the tubular body 17 of the male housing 5 comes into contact with the outside tubular body 41), the packing 43 which is attached to the outer circumferential surface of the inside tubular body 39 is covered with the outside tubular body 41 to its tip. As shown in FIG. 8, the outer circumferential surface of the packing 43 is formed with plural lips 65 and the peaks of the respective lips 65 are located slightly inside the tip 67 of the rib 59 of the outside tubular body 41. A lock target portion 69 which is semicircular in cross section projects from the outer circumferential surface of the brim 49 so as to extend in the circumferential direction. The lock portion 63 of the outside tubular body 41 is located in front of lock target portion 69 of the brim 49 of the inside tubular body 39 and the lock portion 63 comes into contact with the lock target portion 69 from the front side, whereby the outside tubular body 41 is prevented from sliding rearward further. The height of the lock target portion 69 is set at such a value that the lock portion 63 cannot go over it unless a force stronger than a prescribed force is exerted on the outside tubular body 41. The outside tubular body 41 is provided with the pair of lock pieces 61*a* and 61*b* in the rear of the brim 49 of the inside tubular body 39, and is prevented from sliding forward because the lock pieces 61*a* and 61*b* come into contact with the brim 49 from the rear side.

On the other hand, as shown in FIG. 9, in the female housing 37 that is fitted in the male housing 5, the outside tubular body 41 has been slidden so as to be located in the rear of the inside tubular body 39, whereby the rib 59 of the outside tubular body 41 is in contact with a front portion of the front, side surface 51 of the brim 49 of the inside tubular body 39. The outside tubular body 41 is prevented from coming off the inside tubular body 39 because in this manner the rib 59 comes into contact with the side surface 51 of the brim 49 from the front side.

Next, a description will be made of how the male housing 5 and the female housing 37 of the connector 35 according to the second embodiment operate until the former is fitted with the latter.

FIG. 10 illustrates a series of operations of the male housing 5 and the female housing 37. As shown in FIG. 10A, when the female housing 37 is in the prescribed state before fitting, the lock portion 63 is located in front of the lock target portion 69 of the brim 49 of the inside tubular body 39 and the outside tubular body 41 is thereby prevented from sliding rearward (described above with reference to FIGS. 7 and 8). At this time, the packing 43 which is attached to the outer circumferential surface of the inside tubular body 39 is covered with the outside tubular body 41 to its tip.

Figure 10B:
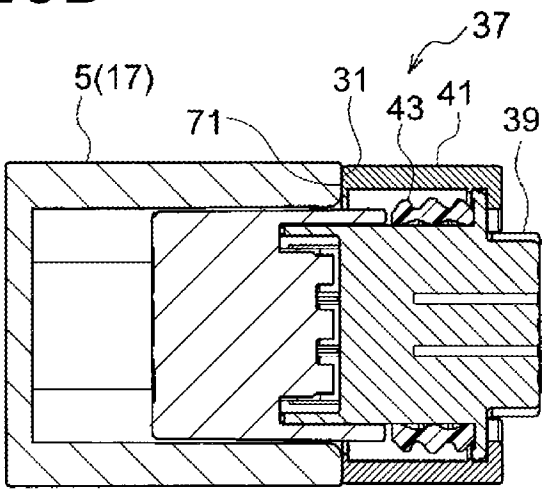
FIGS. 10A to 10D are sectional views illustrating operations of the connector according to the second embodiment of the invention.
Figure 10A:
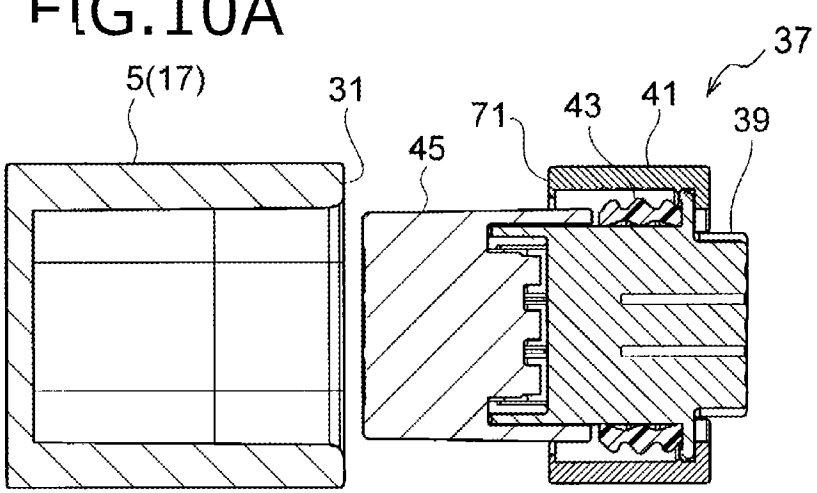

Subsequently, as shown in FIG. 10B, the tubular body 17 of the male housing 5 is pushed toward the female housing 37, the tip surface 31 of the tubular body 17 of the male housing 5 comes into contact with the tip surface 71 of the outside tubular body 41 of the female housing 37. At this time, a tip portion of the inside tubular body 39 (including the front holder 45) of the female housing 37 is inserted into the tubular body 17 of the male housing 5. The inside tubular body 39 (including the front holder 45) is configured so as to guide the tubular body 17 of the male housing 5 so that it is moved toward the outside tubular body 41.

Figure 10D:
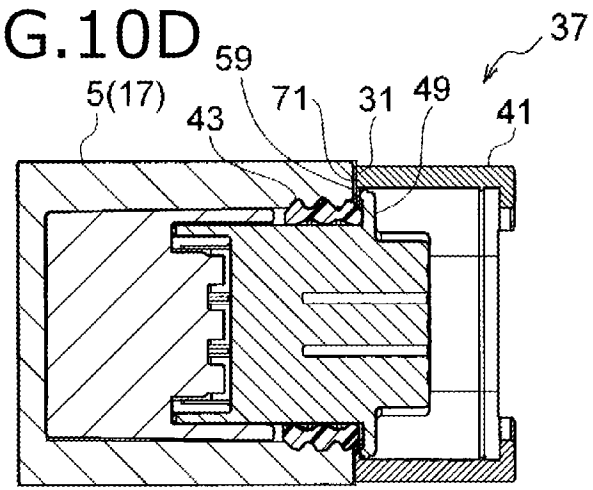
Figure 10C:
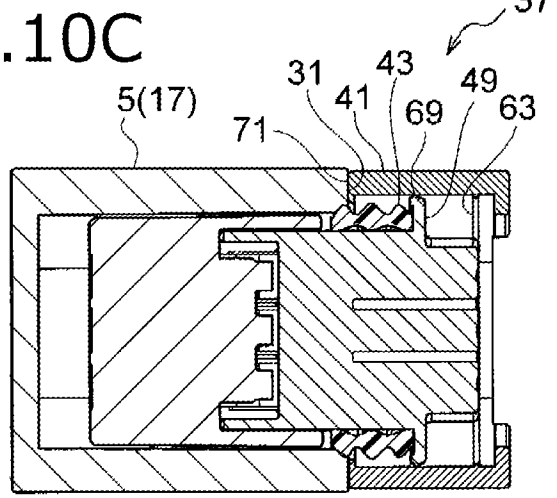

When the male housing 5 is pushed further toward the female housing 37, as shown in FIG. 10C, the female housing 37 is pushed by the tubular body 17 of the male housing 5 in a state that the tip surfaces 71 and 31 are in contact with each other and the lock portion 63 goes over the lock target portion 69 of the brim 49 of the inside tubular body 39 and slides rearward.

Then, as shown in FIG. 10D, a fitting state of the male housing 5 and the female housing 37 is established when the rib 59 of the outside tubular body 41 reaches a position where it comes into contact with the side surface 51 of the brim 49 of the inside tubular body 39 while the tip surface 71 of the outside tubular body 41 and the tip surface 31 of the male housing 5 are kept in contact with each other. Although not shown in FIG. 10, when the male housing 5 reaches the position where it is fitted with the female housing 37, the lock mechanism 7 functions to keep the connected state of the outside tubular body 41 and the male housing 5, that is, the connected state of the male housing 5 and the female housing 37. In this fitting position, the packing 43 which is attached to the outer circumferential surface of the inside tubular body 39 of the female housing 37 which has been inserted into the tubular body 17 of the male housing 5 is in close contact with the inner circumferential surface of the tubular body 17. Thus, watertight sealing is established in the gap between the tubular body 17 of the male housing 5 and the inside tubular body 39 of the female housing 37.

As described above, in the connector 35 according to the second embodiment, the tip surface 71 of the outside tubular body 41 which defines the external shape of the female housing 37 and tip surface 31 of the tubular body 17 which defines the external shape of the male housing 5 come into contact with each other. Thus, it is not necessary to form a space between the inside tubular body 39 and the outside tubular body 41 of the female housing 37. As a result, the connector 35 can be made smaller by setting the external dimensions of the outside tubular body 41 of the female housing 37 the same as or smaller than those of the tubular body 17 of the male housing 5.

Furthermore, in the connector 35 according to the second embodiment, the outside tubular body 41 of the female housing 37 is attached to the inside tubular body 39 from outside so as to be slidable in the axial direction of the inside tubular body 39. Thus, after the tip surface 71 of the outside tubular body 41 of the female housing 37 is pressed against the tubular body 17 of the male housing 5, the outside tubular body 41 of the female housing 37 slides in a state that its tip surface 71 and the tip surface 31 of the tubular body 17 are kept in contact with each other. As a result, at a position where the rib 59 of the outside tubular body 41 comes into contact with the brim 49 of the inside tubular body 39, a state is established that the inside tubular body 39 is inserted in the tubular body 17 of the male housing 5 and the packing 43 which is attached to the inside tubular body 39 comes into close contact with the inner circumferential surface of the tubular body 17 of the male housing 5, whereby necessary waterproofness of the connector 35 can be secured.

Still further, in the connector 35 according to the second embodiment, in the prescribed state before the tubular body 17 of the male housing 5 comes into contact with the outside tubular body 41 of the female housing 37, the packing 43 is covered with the outside tubular body 41 to its tip. Covered with the outside tubular body 41 in advance in this manner, the packing 43 is covered with the tubular body 17 of the male housing 5 and hence can be prevented from being exposed even when the tubular body 17 of the male housing 5 comes into contact with the outside tubular body 41 and causes it to slide. As a result, degradation of the packing 43 due to exposure to an external environment can be suppressed, whereby the connector 35 can be kept waterproof for a long time.

Embodiment 3

Next, a connector according to a third embodiment of the invention will be described.

Figure 11:
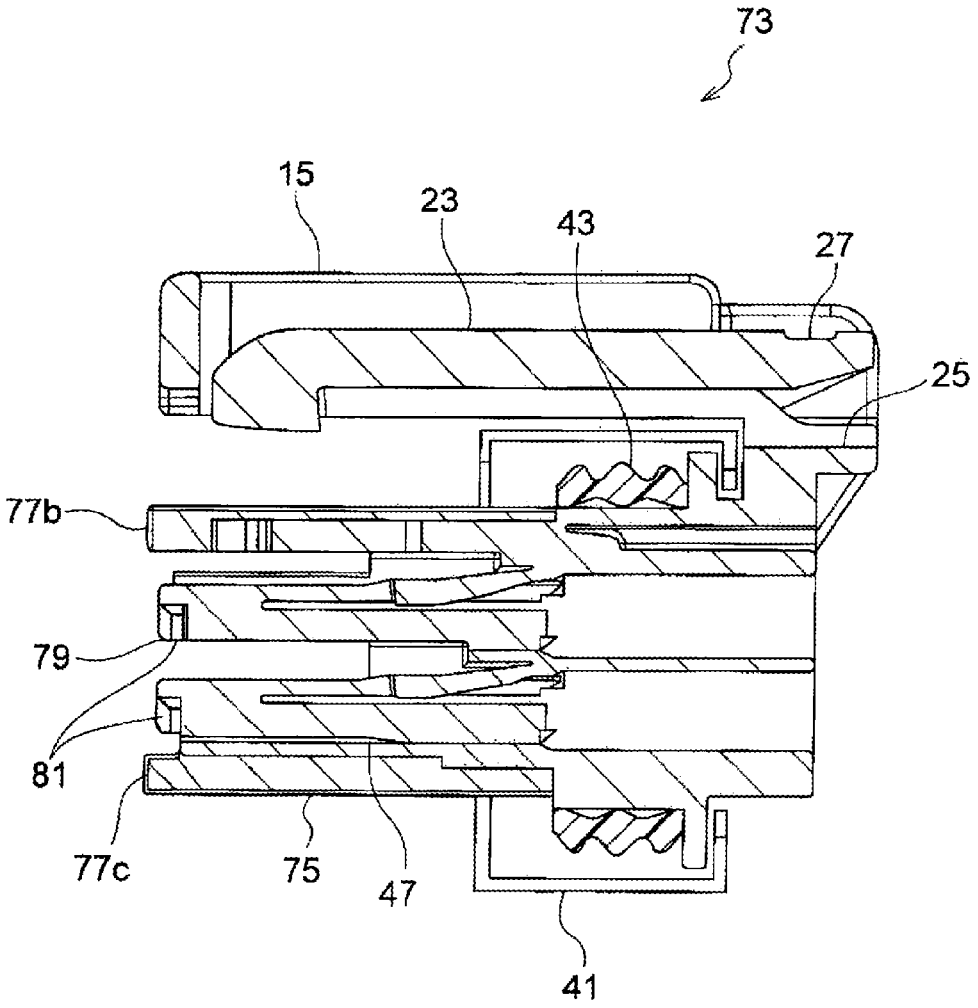
FIG. 11 is a transverse sectional view of a female housing of a connector according to a third embodiment of the invention.
Figure 12:
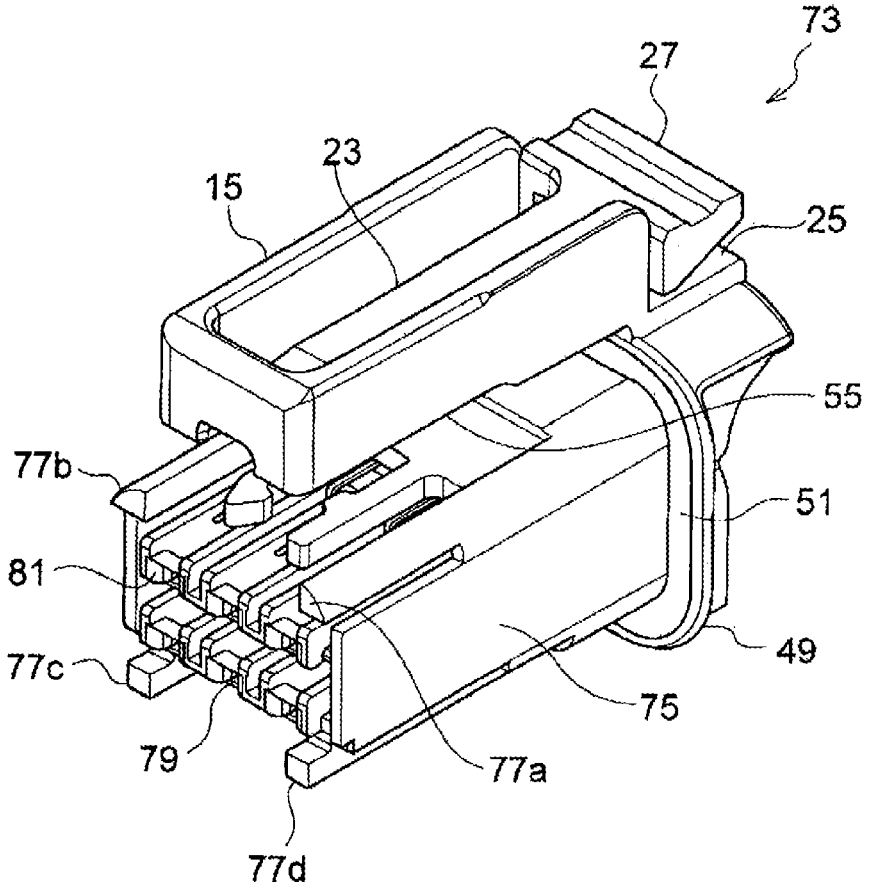
FIG. 12 is a perspective view of an inside tubular body of the female housing shown in FIG. 11.

FIG. 11 is a transverse sectional view of a female housing 73 of a connector according to a third embodiment of the invention. FIG. 12 is a perspective view of an inside tubular body 75 of the female housing 73. FIG. 11 shows an inside tubular body 75 and an outside tubular body 41 but a front holder 45 is omitted. As shown in these figures, in the third embodiment, plural projections 77 (77*a*-77*d*) which are provided at the tip of the inside tubular body 39 of the female housing 37 of the above-described connector 35 according to the second embodiment constitute characterizing feature. Basically, the third embodiment is the same in configuration as the second embodiment.

As shown in FIG. 11, in the female housing 73, the tip of the inside tubular body 75 projects beyond the tip of the outside tubular body 41. The inside tubular body 75 is shaped like a rectangular pipe as a whole, and plural openings 79 are formed at its tip as front openings of respective terminal housing rooms 47. Each opening 79 is provided with a taper portion 81 for guiding a male terminal to be inserted through the opening 79 from the front side.

As shown in FIG. 12, the inside tubular body 75 is provided with the four projections 77*a*-77*d* which project beyond the tip of the inside tubular body 75. The projections 77*a*-77*d* are arranged around the axis of the inside tubular body 39 so as to be spaced from each other and, more specifically, arranged on the rectangle that is formed by the inside tubular body 39. The projections 77*a* and 77*b* project from the tip of the inside tubular body 75 alongside round surfaces of two corner portions of the inside tubular body 75, respectively, and have a fan-shaped cross section. The projections 77*c* and 77*d* project from outer circumferential surfaces of two corner portions of the inside tubular body 75, respectively, and have a rectangular cross section. In the female housing 73 employed in the third embodiment, the projections 77*a* and 77*b* project from the tip surface of the inside tubular body 75 and the projections 77*c* and 77*d* project from the outer circumferential surfaces of the inside tubular body 75. Alternatively, all of the plural projections 77*a*-77*d* may project in one of these forms.

In the female housing 73 employed in the third embodiment, the inside tubular body 75 is provided with the plural projections 77*a*-77*d* which project beyond the tip of the inside tubular body 75. Thus, when, for example, an external object comes into contact with the female housing 73 or the female housing 73 drops onto an external object, one of the projections 77*a*-77*d* comes into contact with the object involved, whereby an event that the object touches the tip (e.g., the taper portion 81 of an opening 79) of the inside tubular body 75 can be prevented. As a result, although the tip of the inside tubular body 75 projects beyond the tip of the outside tubular body 41, the tip of the inside tubular body 75 can be prevented from being damaged. As such, the female housing 73 can guide the male terminals into the respective terminal housing rooms 47 and the reliability of the connector can be increased. Furthermore, since an object comes into contact with the projections 77*a*-77*d*, the impact on the inside tubular body 75 can be reduced to prevent deformation of the terminal housing rooms 47.

In the female housing 73 employed in the third embodiment, the projections 77*a*-77*d* are provided at the respective corners of the inside tubular body 75 because the inside tubular body 75 is shaped like a rectangular pipe. Where the inside tubular body 75 is shaped like a circular pipe, it suffices that plural (at least three) projections 77 which project beyond the tip of the inside tubular body 75 be spaced from each other in the circumferential direction of the inside tubular body 75. The number of projections 77 provided and the length of projection, beyond the tip of the inside tubular body 75, of the projections 77 may be set as appropriate according to the weight and size of the inside tubular body 75.

Embodiment 4

Next, a connector according to a fourth embodiment of the invention will be described.

Figure 13:
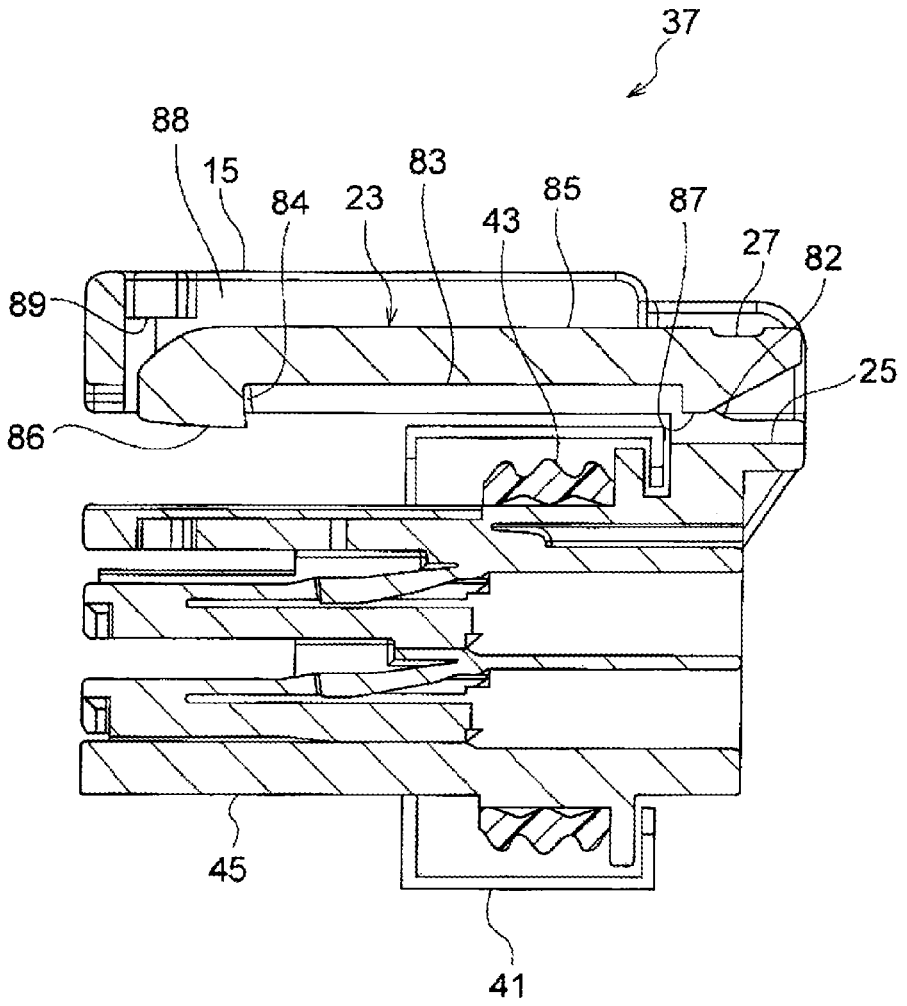
FIG. 13 is a transverse sectional view of a female housing illustrating the structure of a lock arm of a connector according to a fourth embodiment of the invention.

FIG. 13 is a transverse sectional view showing the structure of a lock arm 23 of the connector according to the fourth embodiment of the invention. The fourth embodiment is characterized in a structure for restricting the swing range of the lock arm 23 during a manipulation (hereinafter referred to as a "disengaging manipulation") for disengaging an engagement portion 86 of the lock arm 23 from an engagement target portion 21. Although the following description will be made on the assumption that the configuration of the above-described female housing 37 employed in the second embodiment is employed, the characterizing feature of the fourth embodiment can also apply to any of the other embodiments.

The lock arm 23 is supported by an elastic support member 82 projecting from an outer surface 25 of the female housing 37 so as to be swingable in the plane that is perpendicular to the outer surface 25 of the female housing 37. The lock arm 23 has a pair of first arms 83 which extend from the support member 82 toward the front end side of the female housing 37, a link portion 84 which links front end portions of the pair of first arms 83, and a second arm 85 which extends from the link portion 84 toward the rear end side of the female housing 37 beyond the support member 82. When the female housing 37 is viewed from above, the second arm 85 is located inside the pair of first arms 83.

The engagement portion 86 to engage with the engagement target portion 21 of the male housing 5 when the female housing 37 is fitted into the male housing 5 projects downward from the link portion 84 which links the front end portions of the first arms 83, and a manipulation portion 27 for disengaging the engagement portion 86 from the engagement target portion 21 is provided at the rear end of the second arm 85. A supporting point member 87 whose tip is spaced from the outer surface 25 of the female housing 37 by a set interval is provided between the tip of the second arm 85 and the manipulation portion 27.

As for a manipulation for disengaging the lock arm 23 having the above structure, the manipulation portion 27 which is provided at the rear end of the lock arm 23 is pushed toward the outer surface 25 of the female housing 37, the supporting point member 87 located between the tip of the second arm 85 and the manipulation portion 27 is brought into contact with the outer surface of the female housing 37, and the engagement portion 86 provided at the tip of the lock arm 23 is lifted up in a seesaw-like manner with the contact portion serving as a supporting point. In this case, if the manipulation portion 27 is pushed too much toward the outer surface 25 of the female housing 37, an excessive stress might act on the support member 82 for the lock arm 23 to deform the support member 82 permanently.

In view of the above, in the female housing 37 according to the fourth embodiment, inner surfaces 88 of a protection wall 15 that are located closer to the engagement portion 86 than the support member 82 is and on the two respective sides of the lock arm 23 are formed with respective stoppers 89 which project toward the lock arm 23. The stoppers 89 are formed so as to restrict the upper limit (highest position) of the swing range of the lock arm 23 by coming into contact with the top surface of the lock arm 23 (the pair of first arms 83) swinging upward during a manipulation for disengaging the lock arm 23. The formation height of the stoppers 89 can be set according to a deformation amount of the support member 82 that is allowed during a manipulation for disengaging the lock arm 23. Only one of the pair of inner surfaces 88 may be provided with a stopper 89.

In the female housing 37 according to the fourth embodiment, the inner surfaces 88 of the protection wall 15 that are located on the two respective sides of the lock arm 23 are formed with the respective stoppers 89 which restrict the upper limit of the swing range of the lock arm 23. Thus, in the female housing 37, even if the manipulation portion 27 is pushed too much during a manipulation for disengaging the lock arm 23, the lock arm 23 is not swung beyond the upper limit. As a result, an event that an excessive stress acts on the support member 82 can be prevented and hence permanent deformation of the support member 82 can be prevented.

Embodiment 5

Next, a connector according to a fifth embodiment of the invention will be described.

Figure 14:
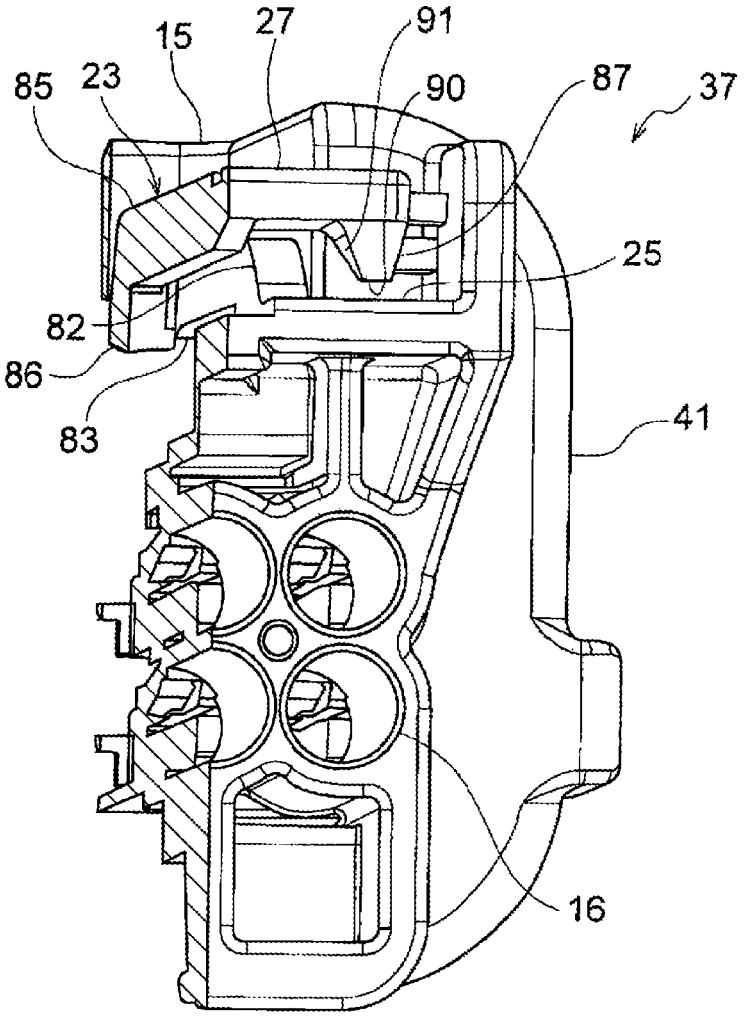
FIG. 14 is a partially sectional, perspective view of a female housing illustrating the structure of a rear end portion of a lock arm of a connector according to a fifth embodiment of the invention.
Figure 15:
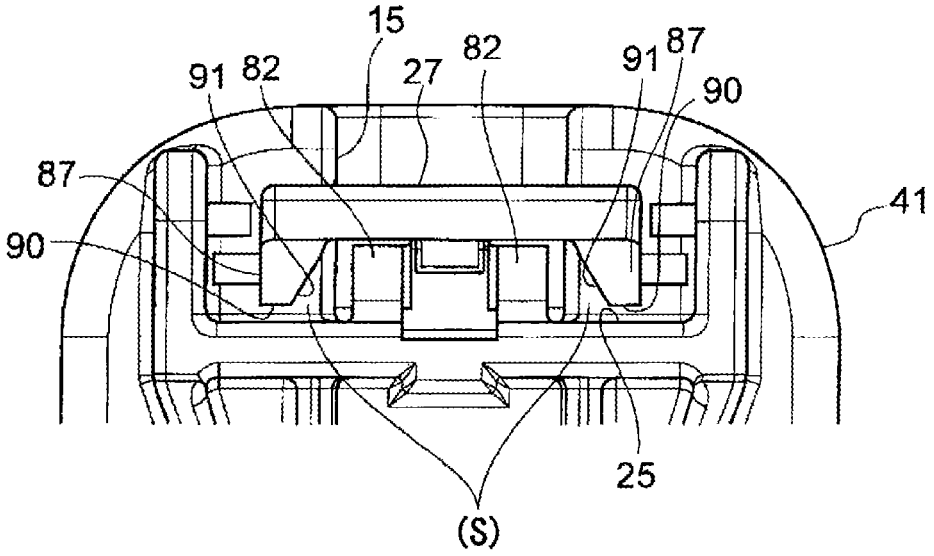
FIG. 15 is a rear view of an essential part of the female housing illustrating the structure of the rear end portion of the lock arm of the connector according to the fifth embodiment of the invention.

FIG. 14 is a partially sectional, perspective view of a rear end portion of a lock arm 23 of the connector according to a fifth embodiment of the invention. FIG. 15 is a rear view of an essential part of the rear end portion of the lock arm 23. The fifth embodiment is characterized in the shape of supporting point members 87 of the lock arm 23. The characterizing feature of the fifth embodiment can also apply to any of the other embodiments.

The lock arm 23 is provided with, between the tip of the second arm 85 and the manipulation portion 27, the supporting point members 87 whose tips are spaced from an outer surface 25 of a female housing 37 by a set interval (see FIG. 13). As shown in FIG. 15, when viewed from the side of the manipulation portion 27 of the lock arm 23, a space S is formed between each supporting point member 87 and a corresponding support member 82. The space S is formed using a component of a die for resin molding. Thus, if, for example, the lock arm 23 is miniaturized and the space is narrowed, the die component is made thinner, which may lower the durability of the die due to insufficiency in strength.

In view of this, the supporting point members 87 employed in the fifth embodiment are tapered so that the interval between each supporting point member 87 and the corresponding support member 82 as viewed from the side of the manipulation portion 27 of the lock arm 23 increases as the position goes toward an outside surface 25 of the female housing 37. That is, in each supporting point member 87, a side surface located on the side of the corresponding support member 82 when viewed from the side of the manipulation portion 27 of the lock arm 23 has such a slant surface 91 that the supporting point member 87 is tapered toward its bottom end 90. With this measure, the space S can be increased and the component of the die for forming the space S can be made thicker. As a result, with the lock arm 23 employed in the fifth embodiment, the die can be increased in strength and hence in durability.

In the lock arm 23 employed in the fifth embodiment, the side surface of each supporting point member 87 has the slant surface 91 which extends to its bottom end 90. Alternatively, the side surface of each supporting point member 87 may be formed with, instead of the slant surface 91, such one or plural steps that the interval between the supporting point member 87 and the corresponding support member 82 increases stepwise. To increase the space S between each supporting point member 87 and the corresponding support member 82, another method is conceivable that a slant surface is formed so that the supporting point member 87 is tapered toward its top end. However, this structure is not preferable because the strength of the structure for supporting the lock arm 23 is lowered.

The invention is not limited to the above embodiments, and various modifications, improvements, etc. can be made as appropriate. The material, shape, dimensions, number (where plural ones are provided), location, etc. of each constituent element of each embodiment are optional and no limitations are imposed on them as long as the invention can be implemented.

The present application is based on Japanese Patent Application No. 2016-250019 filed on Dec. 22, 2016, the disclosure of which is incorporated herein by reference.

Features of the connectors according to the above-described embodiments of the invention will be summarized below concisely:

[1] A connector (1, 35) including:

one housing (female housing 3, female housing 37) having a tubular body (hood 9, inside tubular body 39 and outside tubular body 41) which surrounds terminals;

the other housing (male housing 5) having a tubular body (17) to be connected to the tubular body (hood 9, inside tubular body 39 and outside tubular body 41) of the one housing; and a lock mechanism (7) which allows tip surfaces (29 or 71 and 31) of the tubular bodies (hood 9 or inside tubular body 39 and outside tubular body 41 and tubular body 17) that define external shapes of the pair of housings (female housing 3 or female housing 37 and male housing 5), respectively, to come into contact with each other and maintains a connected state of the one housing and the other housing.

[2] The connector (1, 35) according to item [1], wherein:

the tubular body of the one housing (female housing 37) has an inside tubular body (39) which houses the terminals and an outside tubular body (41) which is disposed so as to be concentric with and to surround the inside tubular body (39);

the outside tubular body is attached, from outside, to the inside tubular body so as to be slidable in an axial direction of the inside tubular body, and has a rib (59) which projects from an inner circumferential surface of the outside tubular body at its front end and prevents the outside tubular body from coming off the inside tubular body by coming into contact with a brim (49) that projects from an outer circumferential surface of the inside tubular body;

a ring-shaped packing (43) which is formed so as to be able to be inserted into the tubular body (17) of the other housing (male housing 5) and is configured to seal a gap between an inner circumferential surface of the tubular body of the other housing and a portion of an outer circumferential surface of the inside tubular body which is located closer to the a side of the inside tubular body than the brim; and the lock mechanism (7) is formed so as to establish the connected state at a position where the tip surface of the tubular body of the other housing comes into contact with a tip surface of the outside tubular body and the rib of the outside tubular body comes into contact with the brim of the inside tubular body.

[3] The connector (35) according to item [2], wherein the outside tubular body of the one housing covers, to its tip, the packing attached to the outer circumferential surface of the inside tubular body in a prescribed state before the tubular body of the other housing comes into contact with the outside tubular body.

[4] The connector (35) according to item [2], wherein: a tip of the inside tubular body (75) projects beyond a tip of the outside tubular body (41);

the inside tubular body has plural projections (77*a*-77) which project beyond the tip of the inside tubular body; and the projections are arranged around the axis of the inside tubular body so as to be spaced from each other.

[5] The connector (35) according to item [1], wherein:

the lock mechanism (7) has a lock arm (23) which is supported by an elastic support member (82) provided on an outer surface (25) of the one housing (female housing 37) so as to be swingable in a plane perpendicular to the outer surface of the one housing (female housing 37), and extends toward a front end side and a rear end side of the one housing (female housing 37);

an engagement portion (86) to engage with an engagement target portion (21) formed on an outer surface (outer circumferential surface 19 of tubular body 17) of the other housing (male housing 5) is formed at a tip of the lock arm, and a manipulation portion (27) for disengaging the engagement portion from the engagement target portion is provided at a rear end of the lock arm; and respective stoppers (89) for restricting an upper limit of a swing range of the lock arm are provided on parts of walls of the one housing, and the parts of the walls are located on two respective sides of the lock arm and are located closer to the engagement portion than the support member.

[6] The connector (35) according to item [1], wherein:

the lock mechanism (7) has a lock arm (23) which is supported by an elastic support member (82) provided on an outer surface (25) of the one housing (female housing 37) so as to be swingable in a plane perpendicular to the outer surface, and extends toward a front end side and a rear end side of the one housing (female housing 37);

an engagement portion (86) to engage with an engagement target portion (21) formed on an outer surface (outer circumferential surface 19 of tubular body 17) of the other housing (male housing 5) is formed at a tip of the lock arm, and a manipulation portion (27) for disengaging the engagement portion from the engagement target portion is provided at a rear end of the lock arm;

the lock arm is provided with, between its tip and the manipulation portion, a supporting point member (87) whose tip is spaced from the outer surface of the one housing by a set interval; and the supporting point member is tapered so that the interval (S) between the supporting point member and the support member as viewed from the side of the manipulation portion of the lock arm increases as the position goes toward the outer surface of the one housing.

The connector according to the invention makes it possible to not only miniaturize the connector but also secure necessary waterproofness of the connector.

What is claimed is:

1. A connector comprising:

one housing having a tubular body which surrounds terminals;

an other housing having a tubular body to be connected to the tubular body of the one housing; and a lock mechanism which allows tip surfaces of the tubular bodies that define external shapes of the pair of housings, respectively, to come into contact with each other and maintains a connected state of the one housing and the other housing, wherein:

the tubular body of the one housing has an inside tubular body which houses the terminals and an outside tubular body which is disposed so as to be concentric with and to surround the inside tubular body;

the outside tubular body is attached, from outside, to the inside tubular body so as to be slidable in an axial direction of the inside tubular body, and has a rib which projects from an inner circumferential surface of the outside tubular body, at a front end of the outside tubular body that is configured to contact the other housing when the one housing and the other housing are connected, and prevents the outside tubular body from coming off the inside tubular body by coming into contact with a brim that projects from an outer circumferential surface of the inside tubular body;

a ring-shaped packing which is formed so as to be able to be inserted into the tubular body of the other housing and is configured to seal a gap between an inner circumferential surface of the tubular body of the other housing and a portion of an outer circumferential surface of the inside tubular body which is located closer to a tip side of the inside tubular body than the brim;

the lock mechanism is formed so as to establish the connected state at a position where the tip surface of the tubular body of the other housing comes into contact with a tip surface of the outside tubular body and the rib of the outside tubular body comes into contact with the brim of the inside tubular body; and the inside tubular body is configured to, when the tip end of the tubular body of the one housing is contacting the tip end of the annular body of the other housing, slide partially out of the outside tubular body in an axial direction of the outside tubular body into the tubular body of the other housing such that the one housing and the other housing become fitted with each other.

2. The connector according to claim 1, wherein the outside tubular body of the one housing covers, to its tip, the ring-shaped packing attached to the outer circumferential surface of the inside tubular body in a prescribed state before the tubular body of the other housing comes into contact with the outside tubular body.

3. The connector according to claim 1, wherein:

a tip of the inside tubular body projects beyond a tip of the outside tubular body;

the inside tubular body has plural projections which project beyond the tip of the inside tubular body; and the projections are arranged around the axis of the inside tubular body so as to be spaced from each other.

4. A connector comprising:

one housing having a tubular body which surrounds terminals;

the other housing having a tubular body to be connected to the tubular body of the one housing; and a lock mechanism which allows tip surfaces of the tubular bodies that define external shapes of the pair of housings, respectively, to come into contact with each other and maintains a connected state of the one housing and the other housing, wherein the lock mechanism includes:

an engagement target portion which is integrally formed on the tubular body of the other housing of the pair of housings whose tip surfaces come into contact with each other;

a lock arm which is integrally formed on the tubular body of the one housing of the pair of housings whose tip surfaces come into contact with each other, and maintains the connected state by engaging with the engagement target portion; and a manipulation portion for disengaging the engagement portion from the engagement target portion is attached at a rear end of the lock arm, the manipulation portion including a body that is configured to cause the lock arm to disengage from the engagement target portion when the body of the manipulation portion is pressed toward an outer surface of the tubular body of the one housing.

5. The connector according to claim 4, wherein:

the lock arm of the lock mechanism is supported by an elastic support member, that is elastic, provided on the outer surface of the one housing so as to be swingable in a plane perpendicular to the outer surface of the one housing, and extends toward a front end side and a rear end side of the one housing;

an engagement portion to engage with the engagement target portion formed on an outer surface of the other housing is formed at a tip of the lock arm; and respective stoppers for restricting an upper limit of a swing range of the lock arm are provided on parts of walls of the one housing, and the parts of the walls are located on two respective sides of the lock arm and are located closer to the engagement portion than the elastic support member.

6. The connector according to claim 4, wherein:

the lock arm of the lock mechanism is supported by an elastic support member, that is elastic, provided on an outer surface of the one housing so as to be swingable in a plane perpendicular to the outer surface of the one housing, and extends toward a front end side and a rear end side of the one housing;

an engagement portion to engage with the engagement target portion formed on an outer surface of the other housing is formed at a tip of the lock arm;

the lock arm is provided with, between its tip and the manipulation portion, a supporting point member whose tip is spaced from the outer surface of the one housing by a set interval; and the supporting point member is tapered so that the interval between the supporting point member and the elastic support member as viewed from the side of the manipulation portion of the lock arm increases as the position goes toward the outer surface of the one housing.

7. The connector according to claim 1, wherein a ring-shaped projection is provided on one of the tip end of the tubular body of the one housing and the tip end of the annular body of the other housing, and a ring-shaped recess is provided on the other of the tip end of the tubular body of the one housing and the tip end of the annular body of the other housing such that the ring-shaped projection is engaged with the ring-shaped recess when the tip end of the tubular body of the one housing is contacting the tip end of the annular body of the other housing.

8. The connector according to claim 4, wherein a ring-shaped projection is provided on one of the tip end of the tubular body of the one housing and the tip end of the annular body of the other housing, and a ring-shaped recess is provided on the other of the tip end of the tubular body of the one housing and the tip end of the annular body of the other housing such that the ring-shaped projection is engaged with the ring-shaped recess when the tip end of the tubular body of the one housing is contacting the tip end of the annular body of the other housing.

* * * * *